United States Patent [19]

Tatkov et al.

[11] 4,083,647

[45] Apr. 11, 1978

[54] SEAL MEANS FOR A CENTRIFUGAL PUMP

[76] Inventors: Viktor Arsentievich Tatkov, prospekt Tsiolkovskogo, 67, kv. 9; Nikolai Nikolaevich Letov, ulitsa Transportnaya, 105, kv. 81, both of Novokuznetsk Kemerovskoi oblasti; Boris Nikolaevich Sharapov, ulitsa Gorkogo, 6, kv. 12; Vladimir Petrovich Rozhkov, ulitsa Zavodskaya, 11, kv. 2, both of Yasnogorsk Tulskoi oblasti, all of U.S.S.R.

[21] Appl. No.: 689,666

[22] Filed: May 24, 1976

[51] Int. Cl.[2] ..... F01D 11/00; F04D 29/10

[52] U.S. Cl. ..... 415/113; 415/170 A; 415/199.1; 277/3

[58] Field of Search ..... 415/111, 113, 170 R, 415/170 A, 198.1, 199.1, 199.2, 199.3; 277/3, 83, 174, 176

[56] References Cited

U.S. PATENT DOCUMENTS

| | | | |
|---|---|---|---|
| 641,624 | 1/1900 | Clarke et al. | 415/113 |
| 846,747 | 3/1907 | Kerr | 415/113 |
| 2,686,657 | 8/1954 | Kalitinsky | 415/113 |
| 2,711,332 | 6/1955 | Audemar | 415/113 UX |
| 3,154,020 | 10/1964 | Sieghartner | 415/113 |
| 3,311,343 | 3/1967 | Miller et al. | 415/111 X |

FOREIGN PATENT DOCUMENTS

| | | | |
|---|---|---|---|
| 1,320,174 | 1/1963 | France | 415/113 |

*Primary Examiner*—Carlton R. Croyle
*Assistant Examiner*—Donald S. Holland
*Attorney, Agent, or Firm*—Haseltine, Lake & Waters

[57] ABSTRACT

A pump for handling liquids laden with abrasive particles in which the seal of the shaft between the low- and high-pressure stages comprises at least two floating rings provided on the shaft in a circular gap between the shaft and the casing. The casing has a circular collar at the side of the low-pressure stage, partly covering the circular gap which is adjoined by the rings during pump operation.

3 Claims, 2 Drawing Figures

SEAL MEANS FOR A CENTRIFUGAL PUMP

FIELD OF THE INVENTION

The present invention relates to centrifugal pumps.

The improvement proposed in the present invention will be most beneficial in centrifugal two-stage pumps employed in mining, metallurgical, chemical and construction industries for handling liquids with suspended abrasive particles, i.e., pulp.

DESCRIPTION OF THE PRIOR ART

Widely known in the art are centrifugal two-stage pumps wherein leakage of fluid along the shaft between the stages is reduced by slot-type seals in the form of a circular gap between the pump casing and shaft.

Such centrifugal pumps are extensively used for handling homogeneous liquids and are practically unsuitable for pumping liquids laden with abrasive matter since the abrasive material entering the circular gap and abrading the surfaces of the casing and shaft enlarges said gap rapidly thus increasing the liquid losses. This, in turn, redistributes the pressure acting on the impellers and increases the unbalanced axial force acting on the thrust bearings of the pump. As a result, the bearings are quickly ruined thus curtailing the service life of the pump.

SUMMARY OF THE INVENTION

An object of the present invention is to provide a centrifugal pump wherein the design of the interstage seal prolongs the life of said pump when it is used for handling pulp containing abrasive particles.

In accordance with this object, we hereby provide a centrifugal pump wherein the seal between the low- and high-pressure stages is located in a circular gap between the casing and the shaft. The casing has a circular collar at the side of the low-pressure stage, said collar partly covering the circular gap. The shaft is mounted with at least two floating rings located in said circular gap, the faces of said rings contacting each other and the circular collar on the casing in the course of pump operation.

It is practicable that the face and internal surfaces of each ring have a layer strengthened with a hard alloy.

Such strengthening will diminish the abrasion of the rings thereby extending their service life.

The centrifugal pump according to the present invention is more reliable and durable than the known pumps and is, therefore, most suitable for use in hydraulic conveying systems in the mining industry for handling pulp.

BRIEF DESCRIPTION OF THE DRAWINGS

Now the invention will be described in detail by way of example with reference to the accompanying drawings, in which.

DETAILED DESCRIPTION OF THE PREFERRED EMBODIMENT

Figure 1:
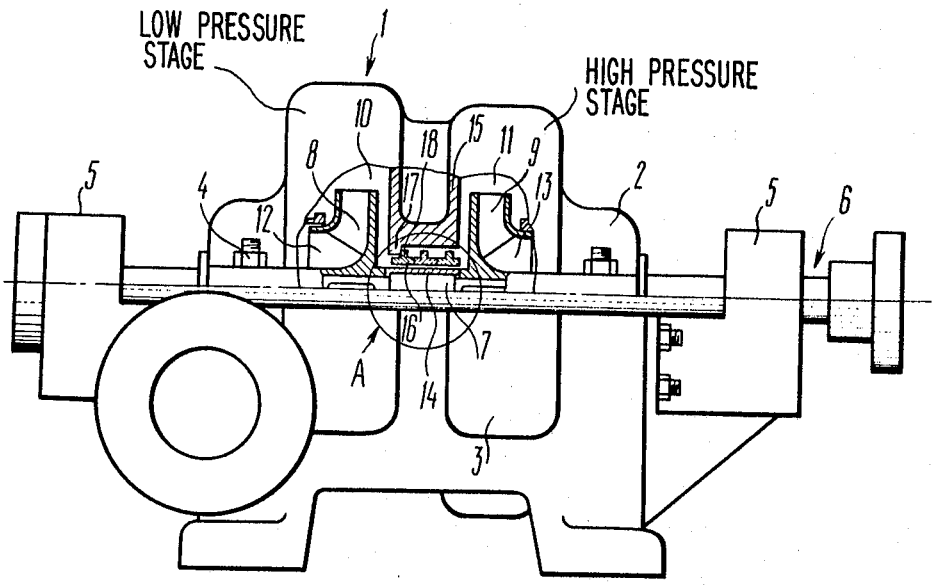
FIG. 1 is an elevational view of the two-stage centrifugal pump according to the invention, partially cutaway at the axis of symmetry.

The centrifugal two-stage pump comprises a casing 1 (FIG. 1) consisting of an upper portion 2 and a lower portion 3 coupled together by clamping members 4.

Installed in the casing 1 on bearings 5 is a rotor 6. The rotor comprises a shaft 7 carrying impellers 8, 9 of the low- and high-pressure stages, respectively. The impellers 8 and 9 are accommodated in chambers 10 and 11, respectively.

Figure 2:
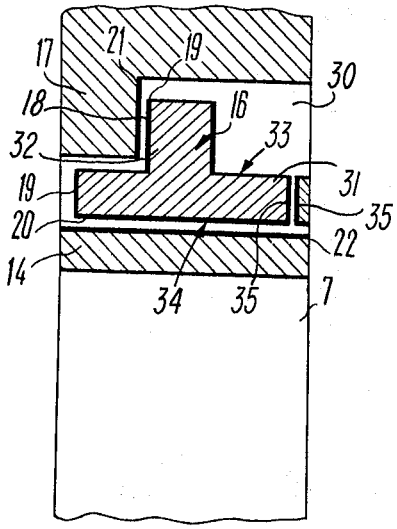
FIG. 2 is an enlarged view of detail "A" in FIG. 1, with the rings separated from one another and from the collar on the casing.

The impellers are mounted on the shaft 7 so that their suction channels 12 and 13 are directed away from each other. Located on the shaft 7 between the impellers 8 and 9 is a bushing 14 which protects the shaft 7 against the damaging effect of the abrasive matter passing through the seal. A circular gap 30 formed between the bushing 14 and the internal wall 15 of the casing 1 separates the chambers 10 and 11. This gap accommodates floating rings 16 provided on the bushing 14 of the shaft 7. Each ring has a T-shaped cross-section comprising a cross member 31 and a stem member 32. The ring has an external cylindrical surface 33 and an internal cylindrical surface 34. The wall 15 of the casing 1 has a circular collar 17 at the side of the low-pressure stage. This collar partly covers the circular gap and, during pump operation, comes into contact with the face 18 located on the external cylindrical surface of the left most one of the rings 16 in FIGS. 1 and 2; the face 35 of each subsequent ring bearing against the preceding ring thus forming the seal of the shaft 7.

To increase the wear resistance of the rings 16, their face surfaces 18, 33, 35 and internal cylindrical surfaces 34 are covered with layers 19 and 20 respectively (FIG. 2) made of a hard alloy based on tungsten, titanium and other elements serving the purpose.

The surfaces of the circular collar 17 and bushing 14 are also strengthened with layers 21, 22 respectively of the same hard alloy.

The centrifugal two-stage pump operates as follows.

Rotation of the rotor 6 builds up static pressure in the pump chambers 10, 11. Pressure in the chamber 11 will be twice as high as that in the chamber 10 since the flow of the handled fluid entering this chamber through a channel (not shown in the drawing) has already passed through the low-pressure stage.

The difference of pressures between the pump stages presses the rings 16 against each other and against the circular collar 17.

The leakage of fluid from the high-pressure to the low-pressure stage will depend on the circular gap between the rings 16 and the bushing 14 under the effect of the pressure difference.

A solid particle getting into the circular gap may become jammed between the inner surface 34 of the ring 16 and the bushing 14 in which case said ring 16 will start rotating together with the shaft 7. This will prevent or at least reduce mechanical damage done to the surfaces of the shaft and bushing. The other rings 16 located between the rotating ring 16 and the collar 17 of the casing 1 will also start to turn thus reducing the relative speed of sliding between the rubbing face surfaces of adjacent rings.

This will reduce the total amount of wear of the rings 16 and shaft 7 because it is commonly known that wear under the conditions of abrasive friction is proportional to the speed of sliding of the friction bodies raised to a power greater than the 1st power.

An experimental model of the two-stage centrifugal pump according to the present invention has been installed in a coal mine for hydraulic lifting of coal. It has provided 1000 hours of working time before the replacement of the rotor whereas the known pumps operate for 300 hours as a maximum before they have to be replaced.

What we claim is:

1. A centrifugal pump having low and high pressure stages and comprising a casing, a shaft rotatably mounted in said casing and forming a circular gap therewith, a seal for said shaft between the low and high pressure stages in the circular gap between said shaft and casing, said casing including a circular collar at the side of the low-pressure stage projecting towards said shaft partially into said circular gap, and a plurality of rings surrounding said shaft and disposed in said circular gap, said rings being freely floating in said gap and being subjected to pressure difference between the low and high pressure stages to be pressed against one another and against said circular collar during pump operation to form a seal for said shaft.

2. A centrifugal pump according to claim 1 wherein each ring has external and internal surfaces covered with a reinforcing layer of an alloy material harder than the material of said rings and collar.

3. A centrifugal pump according to claim 1 wherein said rings have T-shaped cross-sections with cross members and stem members, the stem member of the endmost ring being in abutment with said circular collar during pump operation while the cross members of the rings are in sealing abutment with one another.

* * * * *